US012491446B1

(12) United States Patent
Rao

(10) Patent No.: US 12,491,446 B1
(45) Date of Patent: Dec. 9, 2025

(54) DEVICE FOR SIMULATING SHOOTING RECOIL FORCE AND TOY TANK

(71) Applicant: Zhijiao Rao, Guangdong (CN)

(72) Inventor: Zhijiao Rao, Guangdong (CN)

( * ) Notice: Subject to any disclaimer, the term of this patent is extended or adjusted under 35 U.S.C. 154(b) by 0 days.

(21) Appl. No.: 18/978,632

(22) Filed: Dec. 12, 2024

(30) Foreign Application Priority Data

Nov. 29, 2024 (CN) ..... 202422962600.8

(51) Int. Cl.
*A63H 17/045* (2006.01)
*A63H 17/00* (2006.01)
*A63H 17/26* (2006.01)
*A63H 30/04* (2006.01)

(52) U.S. Cl.
CPC ..... *A63H 17/045* (2013.01); *A63H 17/006* (2013.01); *A63H 17/262* (2013.01); *A63H 30/04* (2013.01)

(58) Field of Classification Search
CPC ..... A63H 17/045; A63H 17/006
See application file for complete search history.

(56) References Cited

U.S. PATENT DOCUMENTS 2,834,332 A * 5/1958 Guthrie ..... F41B 11/51 124/67
3,403,669 A * 10/1968 Crosman ..... F41B 7/00 124/31
3,774,586 A * 11/1973 Saito ..... A63H 17/045 124/31
3,869,825 A * 3/1975 Heberlein ..... A63H 17/045 124/52
8,449,346 B2 * 5/2013 Lee ..... A63H 5/04 434/18
2005/0186884 A1 * 8/2005 Evans ..... A63H 30/04 446/456
2007/0060018 A1 * 3/2007 Chou ..... A63H 17/14 446/456

(Continued)

FOREIGN PATENT DOCUMENTS

CN 110075542 A * 8/2019 ..... A63H 17/045
CN 214582793 U * 11/2021 ..... F41B 11/70
KR 100963483 B1 * 6/2010 ..... F41A 33/06

OTHER PUBLICATIONS

Translation of CN214582793U (Year: 2021).*

*Primary Examiner* — Eugene L Kim
*Assistant Examiner* — Alyssa M Hylinski

(57) ABSTRACT

A device for simulating shooting recoil force includes a main body, a cannon barrel, an elastic restoration device, and a driving device. An installation chamber is defined in the main body. An installation blocking plate is provided inside the installation chamber. The cannon barrel is movably arranged within the installation chamber. The cannon barrel includes a hollow cannon rod and a push rod. The push rod is positioned within the cannon rod. The push rod is slidable within the cannon rod. The cannon rod is provided with a first firing port. A first end of the elastic restoration device is connected to the push rod. A second end of the elastic restoration device abuts against the installation blocking plate. The driving device is connected to the push rod for transmission. The driving device is used for pushing the push rod towards a direction of the installation blocking plate.

10 Claims, 9 Drawing Sheets

(56) References Cited

U.S. PATENT DOCUMENTS

| | | | | |
|---|---|---|---|---|
| 2007/0283941 | A1* | 12/2007 | Tai | F41B 11/642 124/67 |
| 2015/0226513 | A1* | 8/2015 | Lin | F41B 7/08 124/17 |
| 2017/0176132 | A1* | 6/2017 | Kang | F41B 11/71 |
| 2020/0306620 | A1* | 10/2020 | Kennedy | A63F 11/0051 |

* cited by examiner

DEVICE FOR SIMULATING SHOOTING RECOIL FORCE AND TOY TANK

CROSS-REFERENCE TO RELATED APPLICATIONS

The application claims priority of Chinese patent application CN2024229626008, filed on Nov. 29, 2024, which is incorporated herein by reference in its entireties.

TECHNICAL FIELD

The present invention relates to the field of toys, particularly to a device for simulating shooting recoil force and a toy tank.

BACKGROUND ART

Shooting games have always been loved by children, especially toy tanks. Existing toy tanks usually use simple remote control or button control, and although the toy tanks can achieve a certain degree of movement and shooting functions, there is still a big gap in details and realism. For example, the lack of key experiences of the tank such as rotation of a turret, simulated shooting sound effects, and vibration feedback makes it impossible for users to have an immersive combat experience.

Based on this, it is necessary to propose a new toy tank that can realistically simulate actual combat effects and has high interactivity, thereby effectively enhancing fun and playability, better meeting children's needs for shooting games, and providing a more realistic and interesting gaming experience.

SUMMARY

In order to overcome the shortcomings of the prior art, a toy tank is provided in the present invention. The toy tank can realistically simulate actual combat effects and has high interactivity, thereby effectively enhancing fun and playability, better meeting children's needs for shooting games, and providing a more realistic and interesting gaming experience.

The technical solution adopted by the present invention to solve its technical problem is as follows.

A device for simulating shooting recoil force is provided in the present invention. The device for simulating shooting recoil force includes:

- a main body, wherein an installation chamber is defined in the main body, and an installation blocking plate is provided inside the installation chamber;
- a cannon barrel, wherein the cannon barrel is movably arranged within the installation chamber, the cannon barrel includes a hollow cannon rod and a push rod, the push rod is positioned within the cannon rod, the push rod is slidable within the cannon rod, and the cannon rod is provided with a first firing port;
- an elastic restoration device, wherein a first end of the elastic restoration device is connected to the push rod, and a second end of the elastic restoration device abuts against the installation blocking plate; and
- a driving device, wherein the driving device is connected to the push rod for transmission, and the driving device is used for pushing the push rod towards a direction of the installation blocking plate.

When the driving device pushes the push rod towards the direction of the installation blocking plate to a force storage position, the elastic restoration device is compressed. When the driving device releases pulling on the push rod, an elastic restoration force generated when the elastic restoration device is compressed pushes the push rod forward to a firing position, so that the push rod pushes a bullet inside the cannon rod forward to be fired from the first firing port, and the elastic restoration device pushes the installation blocking plate and the main body backward, causing the main body to move backward to simulate an impact effect of the recoil force.

As an improvement of the present invention, a force generated when the elastic restoration device is restored, which is opposite to the elastic restoration force, pushes the installation blocking plate and the main body backwards, so that the main body moves backwards to simulate the impact effect of the recoil force.

As an improvement of the present invention, the driving device includes a first driving motor and a transmission device. The first driving motor is connected to the transmission device for transmission. The first driving motor is provided with an output shaft. The output shaft is provided with a transmission gear. The transmission device includes a first gear, a second gear, a third gear column, a fourth gear, and a fifth gear column. The third gear column includes a first gear portion and a second gear portion. The fifth gear column includes a third gear portion and a fourth gear portion. The first gear, the second gear, the first gear portion, the second gear portion, the fourth gear, the third gear portion, and the fourth gear portion are sequentially connected for transmission. Moreover, the transmission gear is connected to the first gear for transmission.

As an improvement of the present invention, the push rod is equipped with a fifth gear portion. The fifth gear portion is connected to the fourth gear portion for transmission. The first driving motor is used for driving the transmission device, thereby pushing the push rod to a force storage position. When the first driving motor stops driving, the push rod remains in the force storage position.

As an improvement of the present invention, a first accommodating chamber is defined in the cannon rod. A first end of the push rod is arranged in the first accommodating chamber, and the push rod is slidable in the first accommodating chamber. In addition, the first end of the push rod is also provided with a connecting column. An air column is provided on the connecting column. The air column is configured for sealing to generate air pressure to shoot a bullet from the first firing port when the push rod slides in the first accommodating chamber.

As an improvement of the present invention, a second accommodating chamber is defined in the push rod. An opening is defined in a second end of the push rod. The opening is in communication with the second accommodating chamber. A first end of the elastic restoration device is arranged in the second accommodating chamber through the opening and abuts against an inner wall surface of the push rod. A second end of the elastic restoration device abuts against the installation blocking plate, so that when the push rod is pulled to a force storage position, the elastic restoration device is compressed to generate an elastic restoration force to push the push rod forward. At the same time, the elastic restoration device generates a force opposite to a direction of the elastic restoration force to push the installation blocking plate and the main body backward, so that the main body moves backward to simulate an impact effect of the recoil force.

As an improvement of the present invention, a first position limiting block is provided on one side of the cannon rod. A second position limiting block is provided on one side of the push rod. The first position limiting block abuts against the second position limiting block to limit movement of the push rod within the cannon rod.

As an improvement of the present invention, the first firing port is connected to a shooting rod through a connecting member. A first side of the connecting member is provided with a sixth gear portion. A front end of the cannon rod is provided with a seventh gear portion. A fifth gear is provided between the sixth gear portion and the seventh gear portion. When the first driving device pulls the push rod to a force storage position, the shooting rod moves forward under an action of the fifth gear. When the first driving motor releases pulling on the push rod, the push rod moves forward, and the shooting rod moves backward under the action of the fifth gear. The main body is also internally equipped with a first position limiting column and a second position limiting column. The first position limiting column abuts against the first position limiting block, and the second position limiting column abuts against a front end of the fifth gear, so as to limit movement of the cannon rod inside the main body.

As an improvement of the present invention, a through hole is defined in the main body. A bullet hole is defined in the connecting member. The through hole is in communication with the bullet hole, allowing a bullet to enter the bullet hole from an outside. A second side of the connecting member is also provided with a stop block. The stop block abuts against a side wall of the through hole to limit a movement range of the shooting rod. At least one elastic member is further provided between the cannon rod and the main body. The elastic member is used for providing additional pulling force to pull the cannon rod from a force storage position to a firing position. A front end of the cannon rod is provided with at least one first installation column. Front ends of outer wall surfaces of two sides of the main body are respectively provided with at least one installation hole. A second installation column is provided at an edge of the installation hole. A first end of the elastic member is sleeved on the first installation column, and a second end of the elastic member is sleeved on the second installation column. A smoke device is also arranged inside the main body. The smoke device is electrically connected to the driving device to generate smoke to simulate a real combat effect.

A toy tank is further disclosed in the present invention. The toy tank includes a device for simulating shooting recoil force, a base, and a turret. A left side and a right side of the base are respectively provided with a left track type wheel and a right track type wheel. The device for simulating shooting recoil force is arranged inside the turret. The turret is rotatably connected to the base through a rotating device. The rotating device is electrically connected to a second driving motor. The second driving motor is capable of driving the turret to rotate relative to the base. The base is also internally provided with a power driving mechanism and a control circuit board. The second driving motor, the power driving mechanism, and the control circuit board are electrically connected. The control circuit board is connected to a wireless transceiver, an infrared transceiver, and a signal light, enabling the toy tank to be operated and controlled through an external remote controller.

Beneficial effects of the present invention are as follows. The device for simulating shooting recoil force and the tank are disclosed in the present invention. The tank includes the device for simulating shooting recoil force, the base, and the turret. The left side and the right side of the base are respectively equipped with the left track type wheel and the right track type wheel. The device for simulating shooting recoil force is arranged inside the turret. The turret is connected to the base through the rotating device. The device for simulating shooting recoil force in this embodiment can produce a real effect of the recoil force during shooting, increasing the fun and playability of the toy device. A user can not only experience the pleasure of shooting, but also feel the realism brought by the recoil force, enhancing the immersive experience of the game.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

DETAILED DESCRIPTION OF THE EMBODIMENTS

Figure 1:
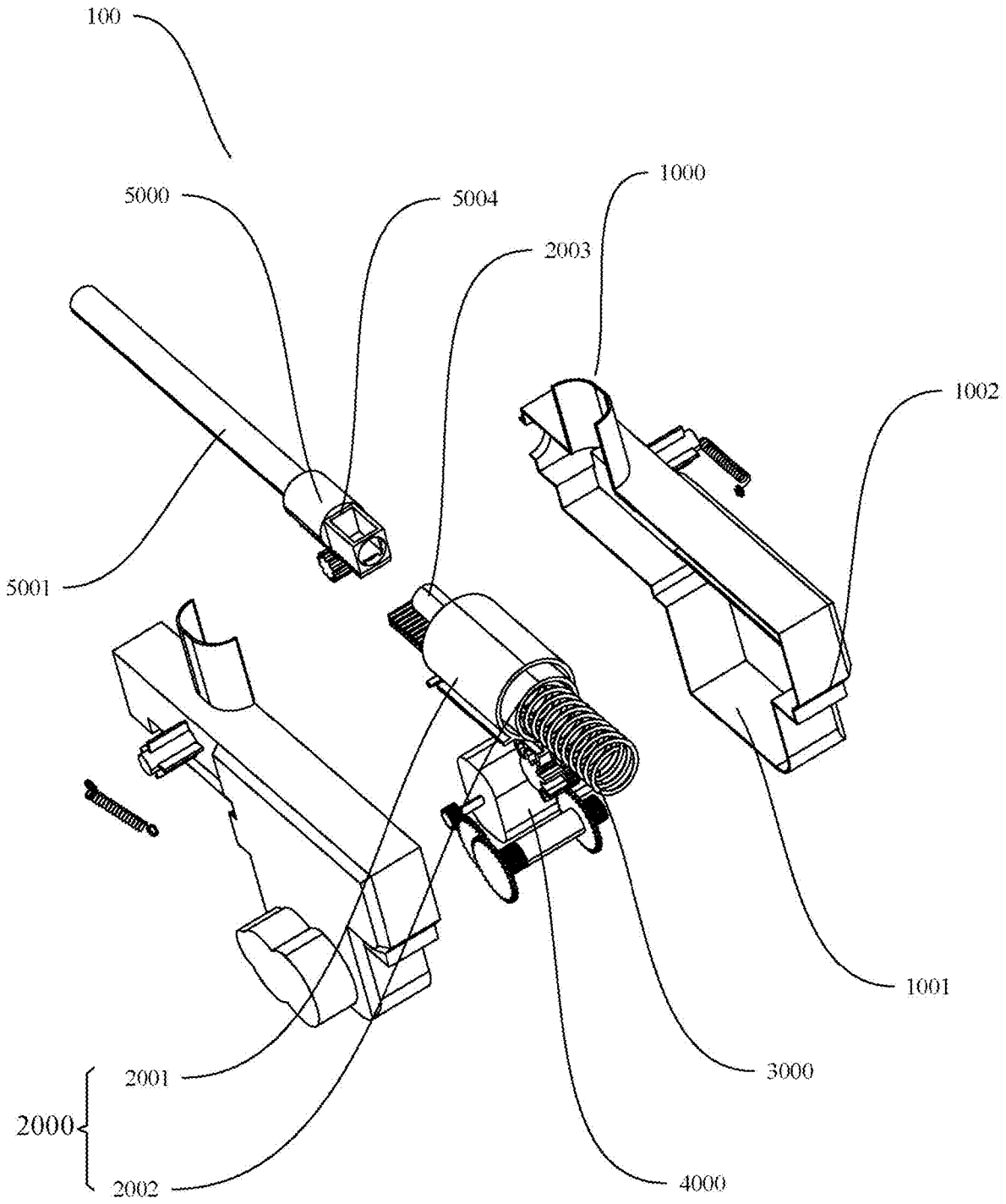
FIG. 1 is a schematic diagram of an exploded structure of a device for simulating shooting recoil force.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the features. In the description of embodiments of the application, "a plurality of" means two or more, unless otherwise specifically defined.

A device 100 for simulating shooting recoil force is disclosed in the present invention, as shown in FIG. 1. The device 100 for simulating shooting recoil force includes:

- a main body 1000, wherein an installation chamber 1001 is defined in the main body 1000, and an installation blocking plate 1002 is provided inside the installation chamber 1001;
- a cannon barrel 2000, wherein the cannon barrel 2000 is movably arranged within the installation chamber 1001, the cannon barrel 2000 includes a hollow cannon rod 2001 and a push rod 2002, the push rod 2002 is positioned within the cannon rod 2001, the push rod 2002 is slidable within the cannon rod 2001, and the cannon rod 2001 is provided with a first firing port 2003;
- an elastic restoration device 3000, wherein a first end of the elastic restoration device 3000 is connected to the push rod 2002, and a second end of the elastic restoration device 3000 abuts against the installation blocking plate 1002; and
- a driving device 4000, wherein the driving device 4000 is connected to the push rod 2002 for transmission, and the driving device 4000 is used for pushing the push rod 2002 towards a direction of the installation blocking plate 1002.

When the driving device 4000 pushes the push rod 2002 towards the direction of the installation blocking plate 1002 to a force storage position, the elastic restoration device 3000 is compressed. When the driving device 4000 releases the pulling on the push rod 2002, an elastic restoration force generated when the elastic restoration device 3000 is compressed pushes the push rod 2002 forward to a firing position, so that the push rod 2002 pushes a bullet inside the cannon rod 2001 forward to be fired from the first firing port 2003, and the elastic restoration device 3000 pushes the installation blocking plate 1002 and the main body 1000 backward, causing the main body 1000 to move backward to simulate an impact effect of the recoil force.

Furthermore, a force generated when the elastic restoration device 3000 is restored, which is opposite to the elastic restoration force, pushes the installation blocking plate 1002 and the main body 1000 backwards, so that the main body 1000 moves backwards to simulate the impact effect of the recoil force.

The elastic restoration device 3000 in this embodiment can generate a realistic effect of the recoil force during shooting. The process that the push rod 2002 is compressed and released by the elastic restoration device 3000 simulates the recoil force in actual shooting, increasing the fun and playability of the toy device. A user can not only experience the pleasure of shooting, but also feel the realism brought by the recoil force, enhancing the immersive experience of the game.

Figure 2:
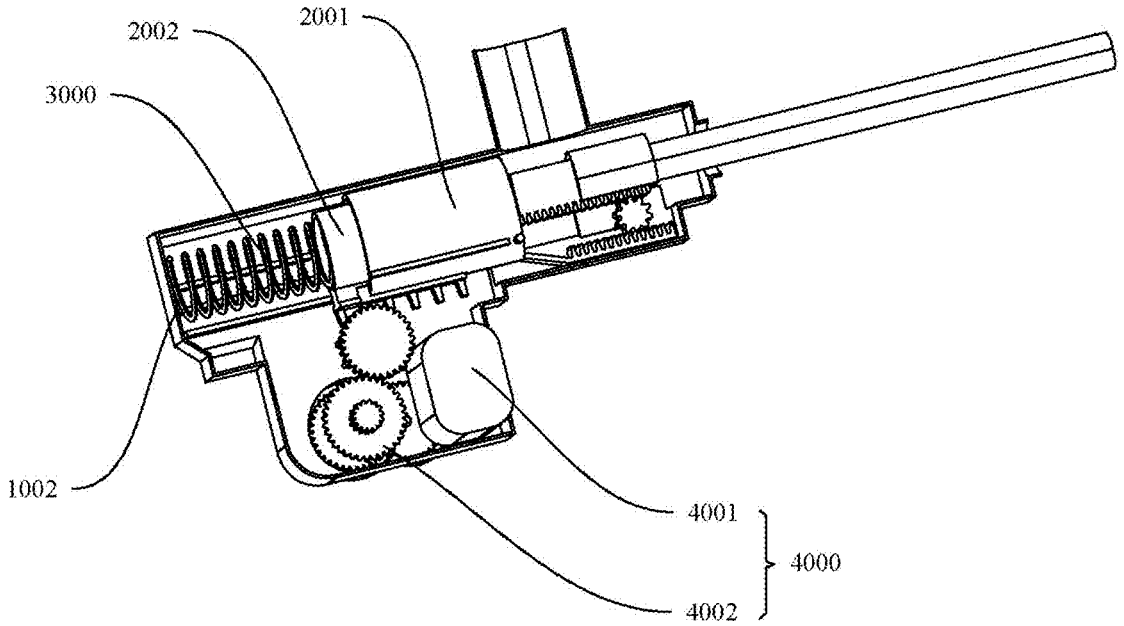
FIG. 2 is a schematic diagram of a connection structure of a cannon barrel and a driving device.
Figure 3:
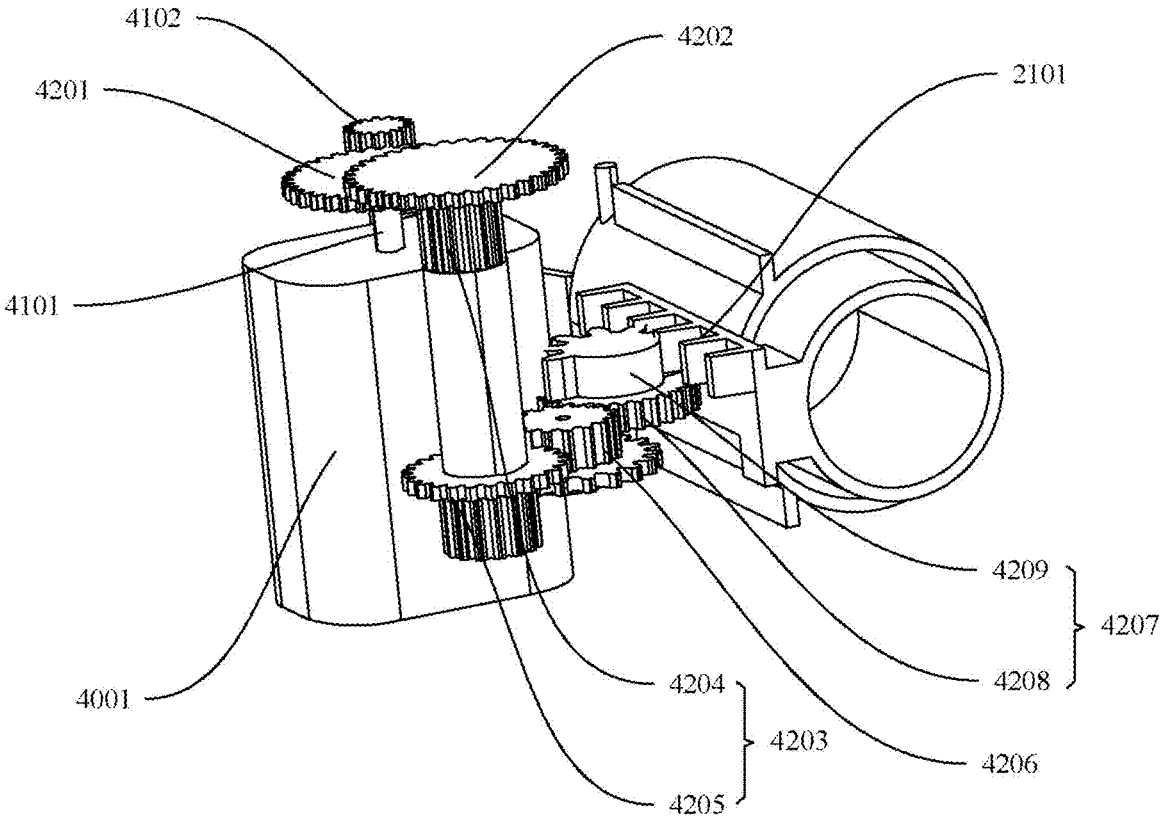
FIG. 3 is a schematic diagram of a structure of a driving device.

In this embodiment, as shown in FIGS. 2-3, the driving device 4000 includes a first driving motor 4001 and a transmission device 4002. The first driving motor 4001 is connected to the transmission device 4002 for transmission. The first driving motor 4001 is provided with an output shaft 4101. The output shaft 4101 is provided with a transmission gear 4102. The transmission device 4002 includes a first gear 4201, a second gear 4202, a third gear column 4203, a fourth gear 4206, and a fifth gear column 4207. The third gear column 4203 includes a first gear portion 4204 and a second gear portion 4205. The fifth gear column 4207 includes a third gear portion 4208 and a fourth gear portion 4209. The first gear 4201, the second gear 4202, the first gear portion 4204, the second gear portion 4205, the fourth gear 4206, the third gear portion 4208, and the fourth gear portion 4209 are sequentially connected for transmission. Moreover, the transmission gear 4102 is connected to the first gear 4201 for transmission.

Figure 4:
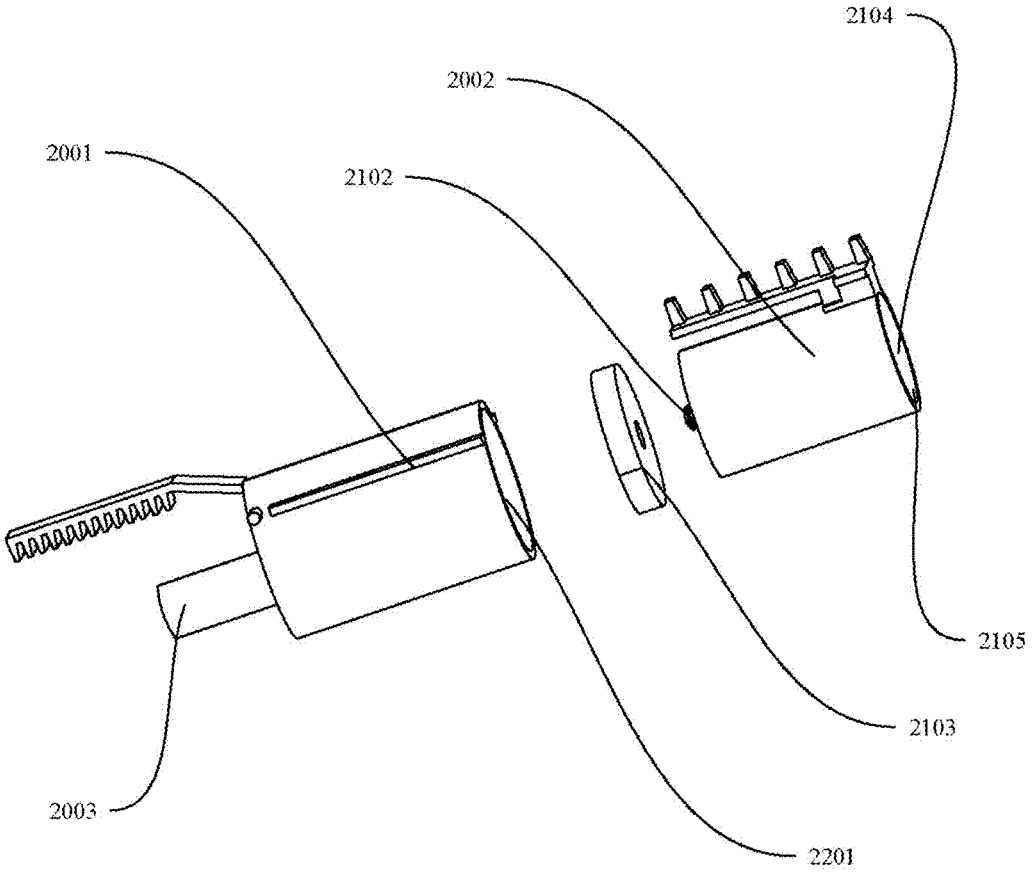
FIG. 4 is a schematic diagram of a structure of a cannon rod and a push rod.

Furthermore, as shown in FIG. 4, the push rod 2002 is equipped with a fifth gear portion 2101. The fifth gear portion 2101 is connected to the fourth gear portion 4209 for transmission. The first driving motor 4001 is used for driving the transmission device 4002, thereby pushing the push rod 2002 to a force storage position. When the first driving motor 4001 stops driving, the push rod 2002 remains in the force storage position.

The first driving motor 4001 and the transmission device 4002 are driven by a multi-stage gear. The transmission device can achieve precise power transmission and control, and the precise coordination of various gear parts makes the operation of the push rod 2002 more accurate, improving the accuracy and controllability of the device. At the same time, the wear of an individual part can also be reduced, and the service life of the device is extended, enabling the user to feel a smooth operating experience during the operation process.

In this embodiment, as shown in FIG. 4, a first accommodating chamber 2201 is defined in the cannon rod 2001. A first end of the push rod 2002 is arranged in the first accommodating chamber 2201, and the push rod 2002 is slidable in the first accommodating chamber 2201. In addition, the first end of the push rod 2002 is also provided with a connecting column 2102. An air column 2103 is provided on the connecting column 2102. The air column 2103 is configured for sealing to generate air pressure to shoot a bullet from the first firing port 2003 when the push rod 2002 slides in the first accommodating chamber 2201.

Furthermore, as shown in FIG. 4, a second accommodating chamber 2104 is defined in the push rod 2002. An opening 2105 is defined in a second end of the push rod 2002. The opening 2105 is in communication with the second accommodating chamber 2104. A first end of the elastic restoration device 3000 is arranged in the second accommodating chamber 2104 through the opening 2105 and abuts against an inner wall surface of the push rod 2002. A second end of the elastic restoration device 3000 abuts against the installation blocking plate 1002, so that when the push rod 2002 is pulled to a force storage position, the elastic restoration device 3000 is compressed to generate an elastic restoration force to push the push rod 2002 forward. At the same time, the elastic restoration device 3000 generates a force opposite to a direction of the elastic restoration force to push the installation blocking plate 1002 and the main body 1000 backward, so that the main body 1000 moves backward to simulate an impact effect of the recoil force.

In this embodiment, the push rod 2002 is slidable inside the first accommodating chamber 2201, and one end is also provided with the air column 2103, so that when the push rod 2002 slides, stable air pressure can be generated inside the first accommodating chamber 2201 to shoot the bullet from the first firing port 2003, thereby improving the shooting effect and stability of the device.

Figure 5:
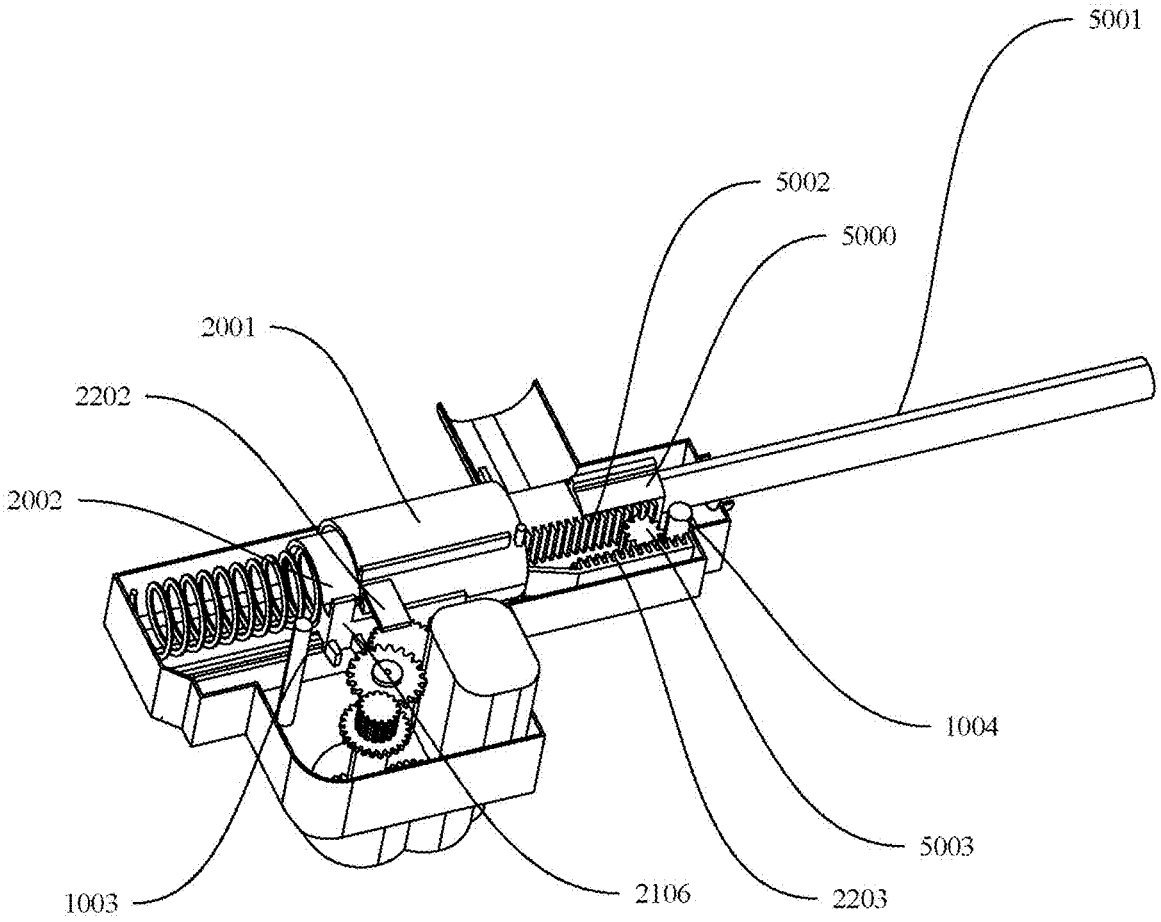
FIG. 5 is a schematic diagram of a connection structure of a cannon rod, a push rod and an installation chamber.

In this embodiment, as shown in FIG. 5, a first position limiting block 2202 is provided on one side of the cannon rod 2001. A second position limiting block 2106 is provided on one side of the push rod 2002. The first position limiting block 2202 abuts against the second position limiting block 2106 to limit movement of the push rod 2002 within the cannon rod 2001, thereby ensuring that the stroke of the push rod is within a controlled range and preventing malfunction or damage caused by excessive movement.

In this embodiment, as shown in FIG. 5, the first firing port 2003 is connected to a shooting rod 5001 through a connecting member 5000. A first side of the connecting member 5000 is provided with a sixth gear portion 5002. A front end of the cannon barrel 2000 is provided with a seventh gear portion 2203. A fifth gear 5003 is provided between the sixth gear portion 5002 and the seventh gear portion 2203. When the first driving device 4000 pulls the push rod 2002 to a force storage position, the shooting rod 5001 moves forward under an action of the fifth gear 5003. When the first driving motor 4001 releases the pulling on the push rod 2002, the push rod 2002 moves forward, and the shooting rod 5001 moves backward under the action of the fifth gear 5003.

By arranging the sixth gear portion 5002, the seventh gear portion 2203, and the fifth gear 5003, the shooting rod 5001 can accurately move forward and backward during the driving process. When the first driving device 4000 pulls the push rod 2002 to the force storage position, the shooting rod 5001 moves forward under the action of the fifth gear 5003, ensuring the accuracy of shooting preparation.

Furthermore, as shown in FIG. 5, the main body 1000 is also internally equipped with a first position limiting column 1003 and a second position limiting column 1004. The first position limiting column 1003 abuts against the first position limiting block 2202, and the second position limiting column 1004 abuts against a front end of the fifth gear 5003, so as to limit movement of the cannon rod 2001 inside the main body 1000, making the movement of the cannon rod 2001 inside the main body 1000 more stable, reducing unnecessary shaking and vibration, and improving the stability and reliability of the system.

Figure 6:
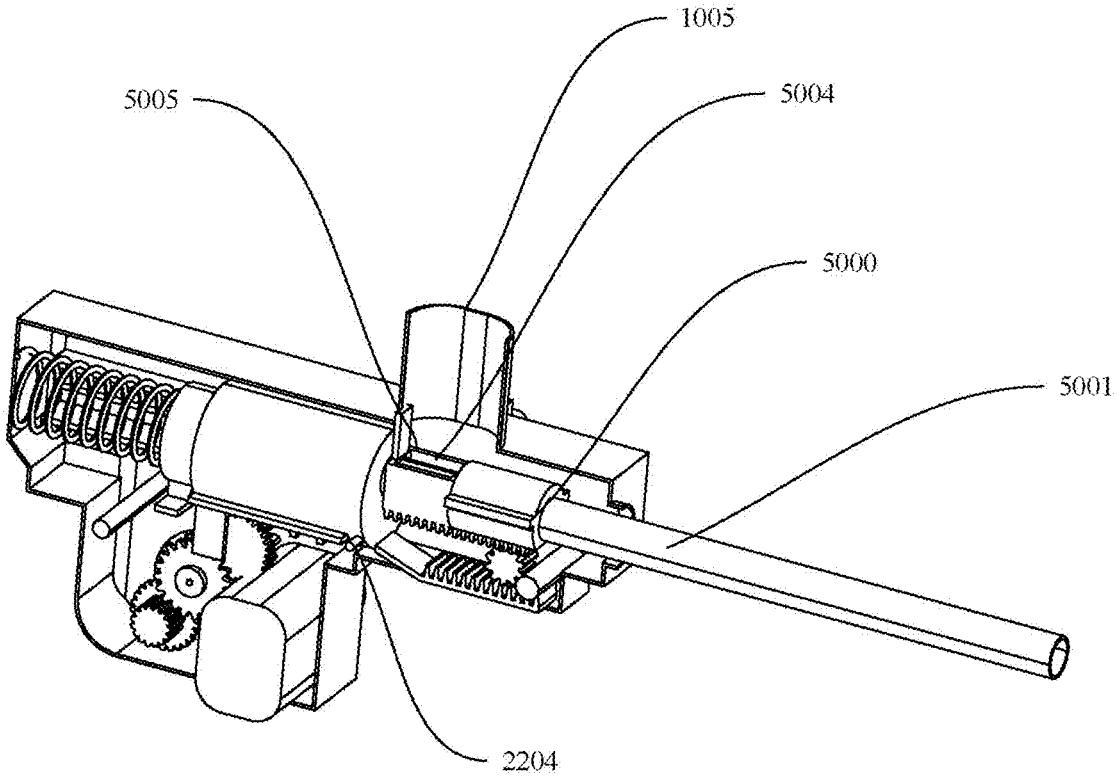
FIG. 6 is a schematic diagram of a connection structure of a shooting rod and a cannon rod.

In this embodiment, as shown in FIG. 6, a through hole 1005 is defined in the main body 1000. A bullet hole 5004 is defined in the connecting member 5000. The through hole 1005 is in communication with the bullet hole 5004, allowing a bullet to enter the bullet hole 5004 from an outside. A second side of the connecting member 5000 is also provided with a stop block 5005. The stop block 5005 abuts against a side wall of the through hole 1005 to limit a movement range of the shooting rod 5001.

The stop block 5005 provided on the connecting member 5000 in this embodiment abuts against the side wall of the through hole 1005, which can effectively limit the movement range of the shooting rod 5001, prevent excessive movement, and ensure that the operation of the shooting rod 5001 is carried out within a controlled range, thereby improving the safety and stability of the operation.

Figure 7:
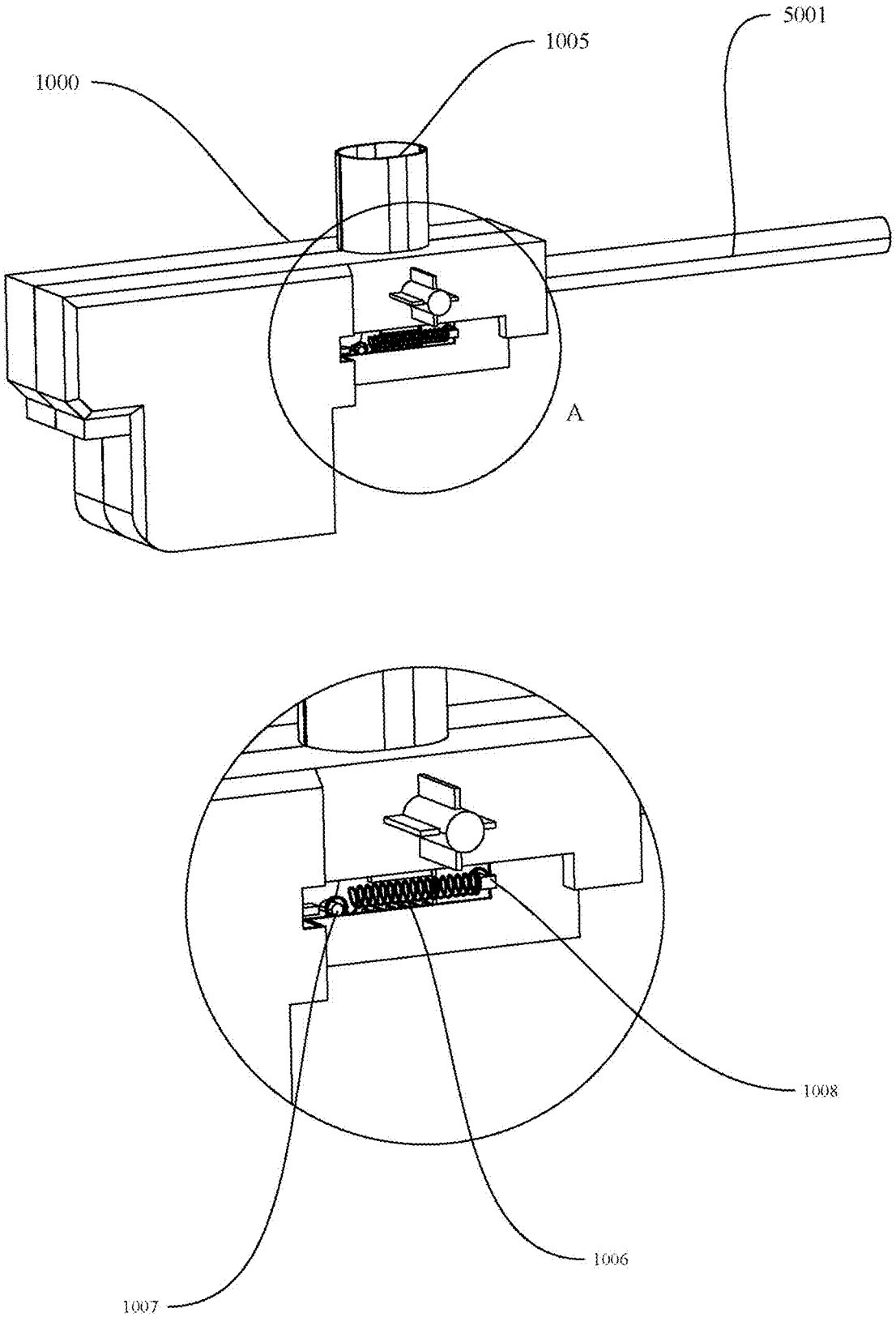
FIG. 7 is a partially enlarged schematic diagram of a connection structure of an elastic member.

Furthermore, as shown in FIG. 7, at least one elastic member 1006 is further provided between the cannon rod 2001 and the main body 1000. The elastic member 1006 can provide additional pulling force to pull the cannon rod 2001 from a force storage position to a firing position. When the cannon rod 2001 is in the firing position and the bullet is fired from the first firing port 2003, the elastic member 1006 generates a force opposite to a direction of the pulling force to push the cannon rod 2001 backward, and together with the elastic restoration device 3000, push the installation blocking plate 1002 and the main body 1000 backward, so that the main body 1000 moves backward to simulate an impact effect of the recoil force.

Two side walls of a front end of the cannon rod 2001 are respectively provided with one first installation column 2204. Front ends of outer wall surfaces of two sides of the main body 1000 are respectively provided with one installation hole 100. A second installation column 1008 is provided at an edge of the installation hole 1007. A first end of the elastic member 1006 is sleeved on the first installation column 2204, and a second end of the elastic member 1006 is sleeved on the second installation column 1008. By arranging the first installation column 2204 and the second installation column 1008 on the front end of the cannon rod 2001 and the outer wall surface of the main body 1000, the elastic member 1006 can be stably connected between the first installation column 2204 and the second installation column 1008, simplifying the internal structure, improving the fixation of a component and the overall stability of the device.

In this embodiment, a smoke device is also arranged inside the main body 1000. The smoke device is electrically connected to the driving device 4000 to generate smoke to simulate a real combat effect.

Figure 8:
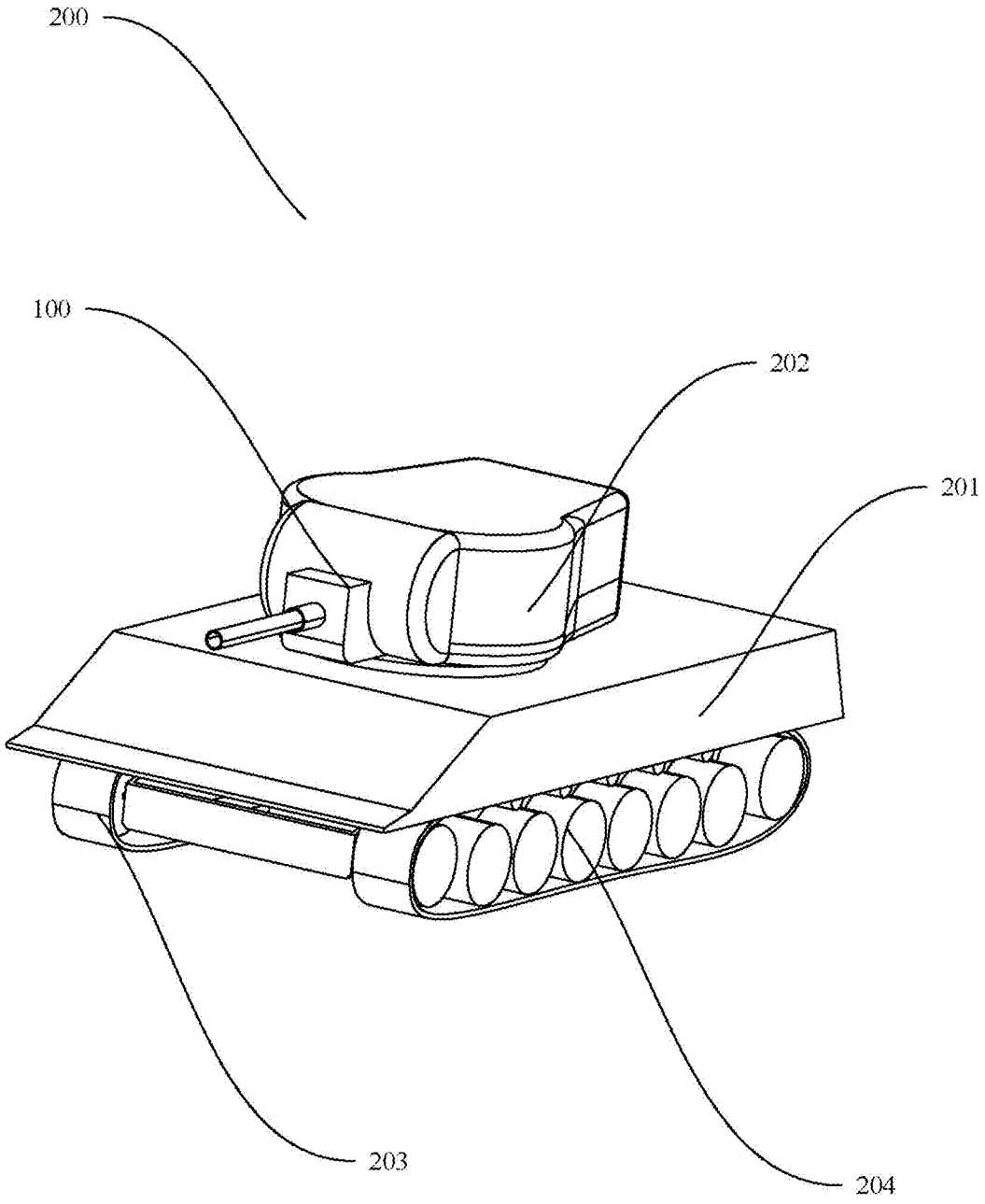
FIG. 8 is a schematic diagram of an overall structure of a toy tank.
Figure 9:
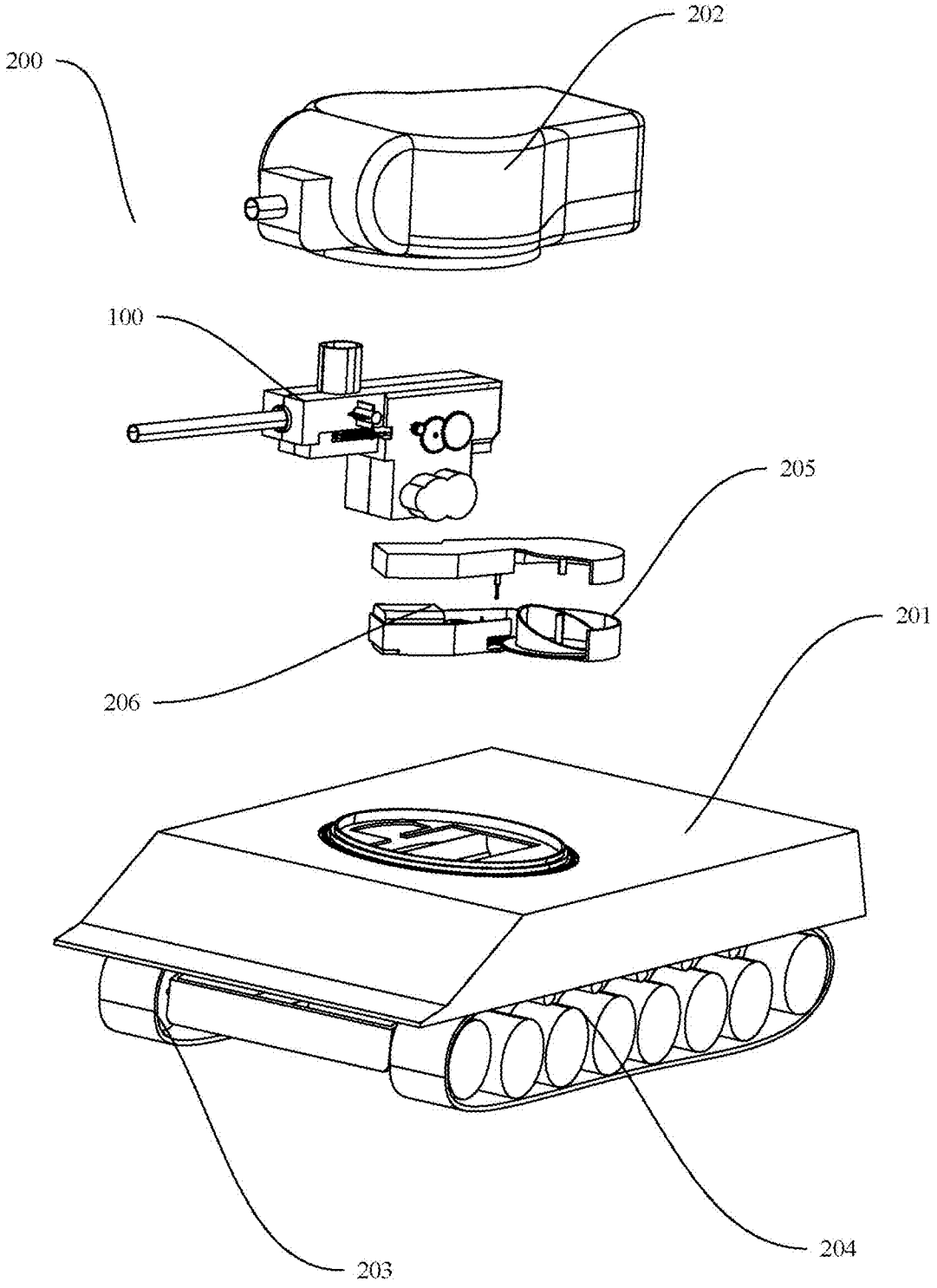
FIG. 9 is a schematic diagram of an exploded structure of a toy tank.

A toy tank 200 is further disclosed in the present invention, as shown in FIGS. 8-9. The toy tank 200 includes a device 100 for simulating shooting recoil force, a base 201, and a turret 202. A left side and a right side of the base 201 are respectively provided with a left track type wheel 203 and a right track type wheel 204. The device 100 for simulating shooting recoil force is arranged inside the turret 202. The turret 202 is rotatably connected to the base 201 through a rotating device 205. The rotating device 205 is electrically connected to a second driving motor 206 to drive the turret 202 to rotate relative to the base 201. The base 201 is also internally provided with a power driving mechanism and a control circuit board. The second driving motor 206, the power driving mechanism, and the control circuit board are electrically connected. The control circuit board is connected to a wireless transceiver, an infrared transceiver, and a signal light, enabling the toy tank 200 to be operated and controlled through an external remote controller.

The toy tank 200 is equipped with the device 100 for simulating shooting recoil force, so that a realistic effect of the recoil force is produced during shooting, thereby enhancing the immersion and realism of the game. By integrating various functions such as simulated shooting, mobile movement, rotation of the turret, and remote control, the toy tank 200 has a high degree of complexity and playability, meeting diverse needs of the user. In addition, the toy tank 200 is provided with the smoke device, which can simulate an effect of discharging exhaust and smoke during the movement of the toy tank 200, making the toy tank 200 more realistic and effectively enhancing the user's experience.

The above description only describes embodiments of the present disclosure, and is not intended to limit the present disclosure; various modifications and changes can be made to the present disclosure. Any modifications, equivalent substitutions, and improvements made within the spirit and scope of the present disclosure are intended to be included within the scope of the present disclosure.

What is claimed is:

1. A device for simulating shooting recoil force, comprising:

a main body, wherein an installation chamber is defined in the main body, and an installation blocking plate is provided inside the installation chamber;

a cannon barrel, wherein the cannon barrel is movably arranged within the installation chamber, the cannon barrel comprises a hollow cannon rod and a push rod, the push rod is positioned within the cannon rod, the push rod is slidable within the cannon rod, and the cannon rod is provided with a first firing port;

an elastic restoration device, wherein a first end of the elastic restoration device is connected to the push rod, and a second end of the elastic restoration device abuts against the installation blocking plate; and a driving device, wherein the driving device is connected to the push rod, and the driving device is for pushing the push rod towards a direction of the installation blocking plate;

wherein when the driving device pushes the push rod towards the direction of the installation blocking plate to a force storage position, the elastic restoration device is compressed; when the driving device releases pulling on the push rod, an elastic restoration force generated when the elastic restoration device is compressed pushes the push rod forward to a firing position, so that the push rod pushes a bullet inside the cannon rod forward to be fired from the first firing port, and the elastic restoration device pushes the installation blocking plate and the main body backward, causing the main body to move backward to simulate an impact effect of the recoil force;

wherein a force generated when the elastic restoration device is restored, which is opposite to the elastic restoration force, pushes the installation blocking plate and the main body backwards, so that the main body moves backwards to simulate the impact effect of the recoil force;

wherein the driving device comprises a first driving motor and a transmission device; the first driving motor is connected to the transmission device for transmission; the first driving motor is provided with an output shaft; and the output shaft is provided with a transmission gear;

wherein the transmission device comprises a first gear, a second gear, a third gear column, a fourth gear, and a fifth gear column; the third gear column comprises a first gear portion and a second gear portion; the fifth gear column comprises a third gear portion and a fourth gear portion; the first gear, the second gear, the first gear portion, the second gear portion, the fourth gear, the third gear portion, and the fourth gear portion are sequentially connected for transmitting motion from the first driving motor to the push rod; and the transmission gear is connected to the first gear for transmitting the motion from the first driving motor to the push rod;

wherein the push rod is equipped with a fifth gear portion; the fifth gear portion is connected to the fourth gear portion for transmission; the first driving motor is used for driving the transmission device, thereby pushing the push rod to the force storage position; and when the first driving motor stops driving, the push rod remains in the force storage position;

wherein a first accommodating chamber is defined in the cannon rod; a first end of the push rod is arranged in the first accommodating chamber; and the push rod is slidable in the first accommodating chamber;

wherein the first end of the push rod is also provided with a connecting column; an air column is provided on the connecting column; and the air column is configured for sealing to generate air pressure to shoot a bullet from the first firing port when the push rod slides in the first accommodating chamber;

wherein a second accommodating chamber is defined in the push rod; an opening is defined in a second end of the push rod; the opening is in communication with the second accommodating chamber; the first end of the elastic restoration device is arranged in the second accommodating chamber through the opening and abuts against an inner wall surface of the push rod;

wherein a first position limiting block is provided on one side of the cannon rod; a second position limiting block is provided on one side of the push rod; and the first position limiting block abuts against the second position limiting block to limit movement of the push rod within the cannon rod;

wherein the first firing port is connected to a shooting rod through a connecting member; a first side of the connecting member is provided with a sixth gear portion; a front end of the cannon rod is provided with a seventh gear portion; a fifth gear is provided between the sixth gear portion and the seventh gear portion; when the first driving device pulls the push rod to the force storage position, the shooting rod moves forward under an action of the fifth gear; and when the first driving motor releases pulling on the push rod, the push rod moves forward, and the shooting rod moves backward under the action of the fifth gear.

2. The device for simulating shooting recoil force according to claim 1, wherein the main body is also internally equipped with a first position limiting column and a second position limiting column; the first position limiting column abuts against the first position limiting block; and the second position limiting column abuts against a front end of the fifth gear, so as to limit movement of the cannon rod inside the main body.

3. The device for simulating shooting recoil force according to claim 2, wherein a through hole is defined in the main body; a bullet hole is defined in the connecting member; and the through hole is in communication with the bullet hole, allowing a bullet to enter the bullet hole from an outside and be fired outward from the shooting rod.

4. The device for simulating shooting recoil force according to claim 3, wherein a second side of the connecting member is also provided with a stop block; and the stop block abuts against a side wall of the through hole to limit a movement range of the shooting rod.

5. The device for simulating shooting recoil force according to claim 4, wherein at least one elastic member is further provided between the cannon rod and the main body; and the elastic member is used for providing additional pulling force to pull the cannon rod from a force storage position to a firing position.

6. The device for simulating shooting recoil force according to claim 5, wherein a front end of the cannon rod is provided with at least one first installation column; front ends of outer wall surfaces of two sides of the main body are respectively provided with at least one installation hole; a second installation column is provided at an edge of the installation hole; a first end of the elastic member is sleeved on the first installation column; and a second end of the elastic member is sleeved on the second installation column.

7. The device for simulating shooting recoil force according to claim 6, wherein a smoke device is also arranged inside the main body; and the smoke device is electrically connected to the driving device to generate smoke to simulate a real combat effect.

8. A toy tank, comprising:

a base;

a turret rotatably connected to the base;

a device for simulating shooting recoil force arranged inside the turret, wherein the device for simulating shooting recoil force comprises a main body, an installation chamber is defined in the main body, and the installation chamber is internally equipped with an installation blocking plate;

a cannon barrel, wherein the cannon barrel is movably arranged within the installation chamber, the cannon barrel comprises a hollow cannon rod and a push rod, the push rod is positioned within the cannon rod, the push rod is slidable within the cannon rod, and the cannon rod is provided with a first firing port;

an elastic restoration device, wherein a first end of the elastic restoration device is connected to the push rod, and a second end of the elastic restoration device abuts against the installation blocking plate; and a driving device, wherein the driving device is connected to the push rod, and the driving device is for pushing the push rod towards a direction of the installation blocking plate;

wherein when the driving device pushes the push rod towards the direction of the installation blocking plate to a force storage position, the elastic restoration device is compressed; when the driving device releases pulling on the push rod, an elastic restoration force generated when the elastic restoration device is compressed pushes the push rod forward to a firing position, so that the push rod pushes a bullet inside the cannon rod forward to be fired from the first firing port, and the elastic restoration device pushes the installation blocking plate and the main body backward, causing the main body to move backward to simulate an impact effect of the recoil force;

wherein a force generated when the elastic restoration device is restored, which is opposite to the elastic restoration force, pushes the installation blocking plate and the main body backwards, so that the main body moves backwards to simulate the impact effect of the recoil force;

wherein the driving device comprises a first driving motor and a transmission device; the first driving motor is connected to the transmission device for transmission; the first driving motor is provided with an output shaft; and the output shaft is provided with a transmission gear;

wherein the transmission device comprises a first gear, a second gear, a third gear column, a fourth gear, and a fifth gear column; the third gear column comprises a first gear portion and a second gear portion; the fifth gear column comprises a third gear portion and a fourth gear portion; the first gear, the second gear, the first gear portion, the second gear portion, the fourth gear, the third gear portion, and the fourth gear portion are sequentially connected for transmitting motion from the first driving motor to the push rod; and the transmission gear is connected to the first gear for transmitting the motion from the first driving motor to the push rod;

wherein the push rod is equipped with a fifth gear portion; the fifth gear portion is connected to the fourth gear portion for transmission; the first driving motor is used for driving the transmission device, thereby pushing the push rod to a force storage position; and when the first driving motor stops driving, the push rod remains in the force storage position;

wherein a first accommodating chamber is defined in the cannon rod; a first end of the push rod is arranged in the first accommodating chamber; and the push rod is slidable in the first accommodating chamber;

wherein the first end of the push rod is also provided with a connecting column; an air column is provided on the connecting column; and the air column is configured for sealing to generate air pressure to shoot a bullet from the first firing port when the push rod slides in the first accommodating chamber;

wherein a second accommodating chamber is defined in the push rod; an opening is defined in a second end of the push rod; the opening is in communication with the second accommodating chamber; the first end of the elastic restoration device is arranged in the second accommodating chamber through the opening and abuts against an inner wall surface of the push rod;

wherein a first position limiting block is provided on one side of the cannon rod; a second position limiting block is provided on one side of the push rod; and the first position limiting block abuts against the second position limiting block to limit movement of the push rod within the cannon rod;

wherein the first firing port is connected to a shooting rod through a connecting member; a first side of the connecting member is provided with a sixth gear portion; a front end of the cannon rod is provided with a seventh gear portion; a fifth gear is provided between the sixth gear portion and the seventh gear portion; when the first driving device pulls the push rod to the force storage position, the shooting rod moves forward under an action of the fifth gear; and when the first driving motor releases pulling on the push rod, the push rod moves forward, and the shooting rod moves backward under the action of the fifth gear.

9. The toy tank according to claim 8, wherein a left side and a right side of the base are respectively provided with a left track type wheel and a right track type wheel; the device for simulating shooting recoil force is arranged inside the turret; the turret is rotatably connected to the base through a rotating device; the rotating device is electrically connected to a second driving motor; and the second driving motor is capable of driving the turret to rotate relative to the base.

10. The toy tank according to claim 9, wherein the base is also internally provided with a power driving mechanism and a control circuit board; the second driving motor, the power driving mechanism, and the control circuit board are electrically connected; and the control circuit board is connected to a wireless transceiver, an infrared transceiver, and a signal light, enabling the toy tank to be operated and controlled through an external remote controller.

* * * * *